United States Patent [19]

Rosenberg

[11] 4,235,474

[45] Nov. 25, 1980

[54] HARNESS FOR RETAINING A BABY IN A CHAIR

[76] Inventor: Linda H. Rosenberg, 4007 Sanlee Rd., Randallstown, Md. 21133

[21] Appl. No.: 929,824

[22] Filed: Jul. 31, 1978

[51] Int. Cl.[3] ..... A47C 31/00

[52] U.S. Cl. ..... 297/465; 297/468; 297/485

[58] Field of Search ..... 297/384, 385, 389, 223, 297/221, 219, 465, 468, 485

[56] References Cited

U.S. PATENT DOCUMENTS

| | | | |
|---|---|---|---|
| 1,616,349 | 2/1927 | Cagle | 297/389 |
| 2,652,183 | 9/1953 | Hlivka | 297/385 X |
| 2,790,486 | 4/1957 | Hardie | 297/385 |
| 2,848,040 | 8/1958 | Chernivsky | 297/385 X |
| 3,099,486 | 7/1963 | Scott | 297/389 |
| 3,136,581 | 6/1964 | Caballero | 297/384 |
| 3,235,306 | 2/1966 | Chernivsky | 297/385 X |
| 3,380,776 | 4/1968 | Dillender | 297/385X |
| 3,604,750 | 9/1971 | Doering | 297/389 |
| 3,713,692 | 1/1973 | McCracken et al. | 297/385 |
| 4,050,737 | 9/1977 | Jordan | 297/389 |

*Primary Examiner*—James T. McCall

*Attorney, Agent, or Firm*—Clarence A. O'Brien; Harvey B. Jacobson

[57] ABSTRACT

A harness for retaining a baby in a chair has a body member constructed from a flexible material and including a chair engaging section for attaching the body member to a chair, and a baby holding section connected to the chair engaging section for retainingly holding a baby on the associated chair. The chair engaging section comprises a pocket formed in the body member and arrangeable over a back of the chair, while the baby holding section has a crotch portion connected to the pocket and terminating in a strap arranged for extending around the midsection of the baby and being tied behind the back of the chair so as to firmly retain the baby on a seat of the chair.

1 Claim, 6 Drawing Figures

HARNESS FOR RETAINING A BABY IN A CHAIR

BACKGROUND OF THE INVENTION

1. Field of the Invention

This invention relates generally to devices for holding a baby in a chair, and particularly to a harness for retaining a baby in a conventional armless, straight back chair, and the like.

2. Description of the Prior Art

Numerous devices have been proposed for retaining a baby, or young child, in a high chair. Examples of such devices can be found in U.S. Pat. Nos: 2,451,007, issued Oct. 12, 1948, to G. K. White; 2,652,183, issued Sept. 15, 1953, to B. Hlivka; and 3,125,373, issued Mar. 17, 1964, to M. E. Boatman. Further, U.S. Pat. No. 3,181,530, issued May 4, 1965, to E. J. Storey, discloses a restraint for inhibiting motion of a person, not necessarily an infant or child, in a bed, chair and the like, while U.S. Pat. No. 3,245,382, issued Apr. 12, 1966, to M. E. Easley, et al., discloses an infant restraining device readily attachable to a high chair or other chair or article of furniture to position an infant adjacent the front edge of the chair in such a manner as to prevent the infant from standing or otherwise falling from the chair or other article of furniture.

SUMMARY OF THE INVENTION

It is an object of the present invention to provide a harness for retaining a baby on the seat of a chair in a simple and comfortable, yet reliable and safe manner.

Another object of the present invention is to provide a baby restraining harness which securely holds a baby on the seat of any straight back chair without restraining movement of the child's arms and legs.

Still another object of the present invention is to provide a harness for retaining a baby on a chair which will provide back support for an infant.

Yet another object of the present invention is to provide a harness for retaining a baby on a chair which is easy to secure on or remove from a chair, and can be easily washed and folded to convenient size for storage.

These and other objects are achieved according to the present invention by providing a harness having: a body member constructed from a flexible material and including a chair engaging section for attaching the body member to a chair, and a baby holding section connected to the chair engaging section for retainingly holding a baby on the chair. Preferably, the chair engaging section comprises a pocket formed in the body member and arrangeable over a back of the associated chair, while the baby holding section comprises a crotch portion connected to the pocket. The crotch portion advantageously terminates in a strap arranged for passing around the midsection of the baby and being tied behind the back of the associated chair in a simple manner for securely retaining the baby on a seat of the associated chair.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
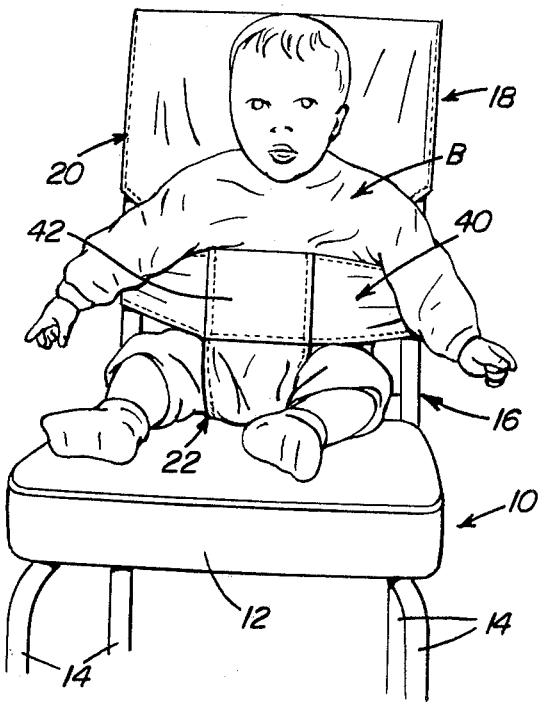
FIG. 1 is a schematic, fragmentary, front perspective view showing a baby retained on the seat of a straight back chair by a harness according to the present invention.

Referring now more particularly to the figures of the drawing, a conventional straight back chair 10 is illustrated, which chair 10 includes a generally planar seat 12 supported by four legs 14 and having extending upwardly from the rear of seat 12 a generally straight back 16. A baby B is illustrated as restrained on the seat 12 of chair 10 by a harness 18 according to the present invention, which harness 18 comprises a body member constructed from a suitable flexible material and including a chair engaging section 20 for attaching the body member to back 16 of chair 10, and a baby holding section 22 connected to section 20 and engaging baby B for retainingly holding same on seat 12 in a position against the back 16 of chair 10.

Chair engaging section 20 of harness 18 comprises a pocket 24 formed in the body member and arrangeable over back 16 of chair 10. More specifically, pocket 24 includes a front piece 26 to which is attached a back piece 28 as by the illustrated stitching 30 around only three sides of back piece 28 so as to form an opening 32 along the lower edge of piece 28 and permit access into the interior of pocket 24.

Front piece 26 extends into a crotch portion 34, with a tapered transition zone 36 extending from front piece 26 to a shank 38 of portion 34. Shank 38 extends longitudinally from transition zone 36 to a tie strap 40 disposed extending substantially perpendicularly to the longitudinal extent of shank 38 and retained at the end thereof spaced fartherest from pocket 24 by a suitable flap 42 folded around the midportion of tie strap 40 and fastened thereto as by the illustrated conventional stitching 44.

Figure 3:
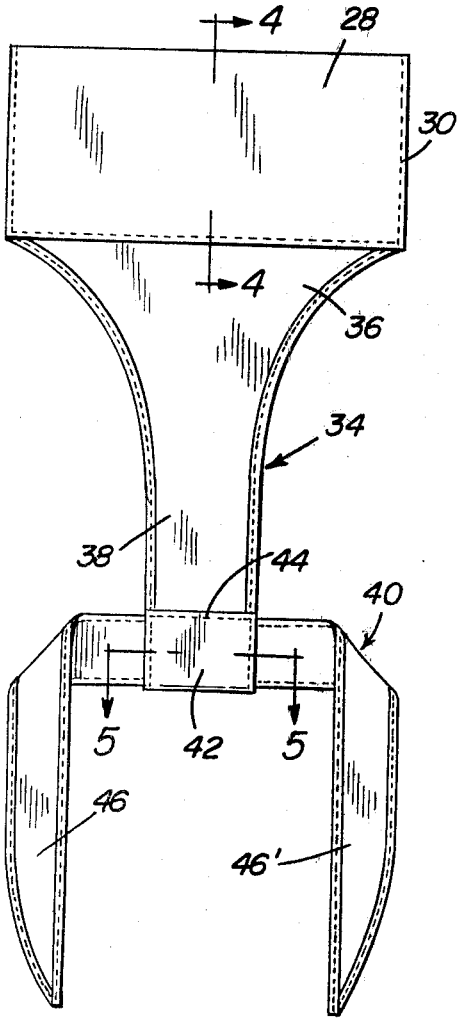
FIG. 3 is a plan view showing a harness according to the present invention.
Figure 2:
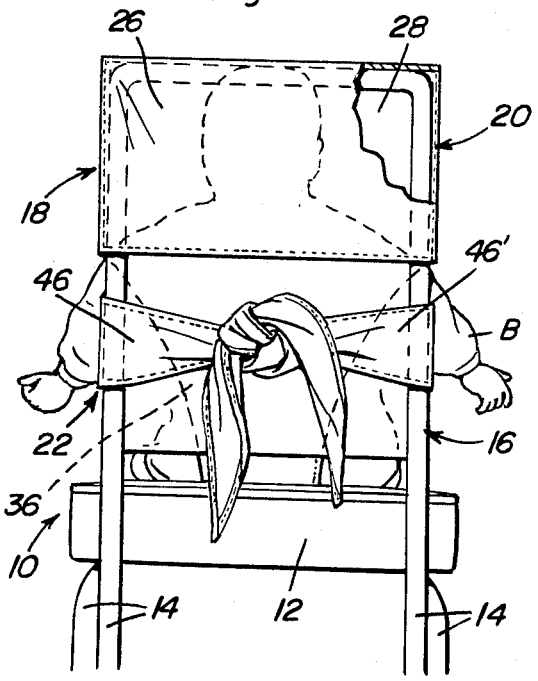
FIG. 2 is a schematic, fragmentary, elevational view looking from the rear of FIG. 1.
Figure 4:
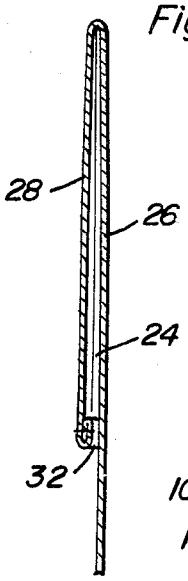
FIG. 4 is an enlarged, fragmentary, sectional view taken generally along the line 4—4 of FIG. 3.
Figure 6:
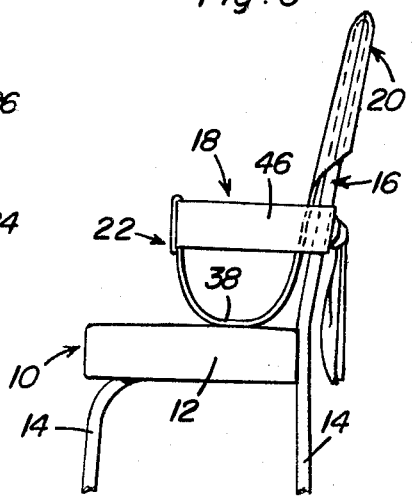
FIG. 6 is a schematic, fragmentary, side elevational view showing a harness according to the present invention disposed on a straight back chair.
Figure 5:
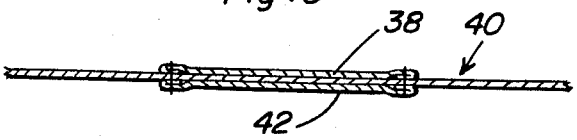
FIG. 5 is an enlarged, fragmentary, sectional view taken generally along the line 5—5 of FIG. 3.

Tie strap 40 includes a pair of arms 46 and 46' disposed extending in opposite directions from the area of flap 42, and transversely to the longitudinal extent of shank 38 of crotch portion 34, so as to wrap around the midsection of baby B and be tieable in a simple manner behind the back 16 of chair 10. As can best be seen from FIG. 3, the free ends of the arms 46, 46' are tapered toward a point in order to facilitate tieing of strap 40. Once so tied behind back 16 of chair 10, baby B will be securely retained on seat 12 against back 16 of chair 10 in a reliable and safe, yet comfortable manner.

As can be readily understood from the above description and from the drawing, a harness according to the present invention permits a child to be retained on a straight back chair, and the like, in a simple, yet comfortable manner, and because of the position of the baby up against the back of the chair, the harness can be used from the time the baby can hold up its head. The harness can be used with any straight back chair, and the like, with or without a booster seat, and prevents the child from standing or falling from the chair. The baby cannot fall through the harness, which is made even simpler to use because it will fit in only one direction. The ties have no rough edges or buckles that could break or harm the child, with the harness being comfortable and not looking or working like a straight jacket. Further, the harness does not restrain movement of the infant's arms or legs. The harness can be constructed from a suitable fabric, appropriately treated for strain resistance, or a synthetic resin so as to be washer and dryer safe, resist fading and shrinking, and to never need ironing, and is capable of being folded to a convenient size for storage and for being transported together with the baby on trips, visits, and the like.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. In combination with a chair having a generally horizontally disposed seat and upstanding back oriented in rigid relationship with the front and side edges of the seat being open, a harness for retaining a baby in the chair, said harness comprising a body member constructed of flexible fabric material and including a chair back receiving pocket, a crotch engaging portion and a tie strap, said pocket comprising a rectangular panel reversely folded to form a top edge and a pair of panels secured together along the generally parallel side edges with the bottom edges left unattached to form a downwardly opening pocket for sliding downwardly over the top edge portion of the chair back, said pocket forming panels having substantial vertical dimension whereby the pocket will receive a substantial portion of the chair back, said crotch engaging portion including an extension unitary with the lower edge of the front panel of the pocket, said extension having inwardly curving side edges originating at the side edges of the lower end of the front panel of the pocket and merging into generally parallel side edges defining a crotch strap extending between the legs of a baby, said tie strap extending perpendicular to the forward end of the crotch strap and being fixedly secured thereto, said tie strap being narrower than the crotch strap and extending an equal distance to both sides thereof, the extension and crotch strap having a length to position the forward end of the crotch strap and the central portion of the tie strap in position for engagement with the midsection of the chest and stomach area of a baby with the tie straps extending under the armpit area of the baby and around the side edges of the chair back below the pocket; said tie strap terminating in free ends to enable the tie strap to be secured in place by tying a knot behind the chair back, the forward end of the crotch strap extending across the inner surface of the tie strap, folded over the top edge of the tie strap and extending downwardly across the outer surface of the tie strap to a terminal end edge coinciding with the bottom edge of the tie strap, the end portion of the crotch strap being secured to the tie strap by stitching with the multiple layers of material defining a generally rectangular stiffened area engageable with the front midsection of the baby and maintaining the straps in a flat unfolded condition, the free end portions of the tie strap being tapered to facilitate the formation of a knot, said extension and crotch strap extending along the surface of the chair back and seat with the weight of the baby being supported by engagement with the chair seat with the baby oriented in substantially upright seated position on the crotch portion of said harness and having freedom of movement of the arms and legs.

* * * * *